US007891141B2

(12) United States Patent
Kennedy

(10) Patent No.: US 7,891,141 B2
(45) Date of Patent: Feb. 22, 2011

(54) BRACKET ASSEMBLY FOR SUPPORTING A ROTATABLE GUTTER SYSTEM

(76) Inventor: Martin Anthony Kennedy, 54 Cambridge, Port Noarlunga, South Australia (AU) 5167

( * ) Notice: Subject to any disclaimer, the term of this patent is extended or adjusted under 35 U.S.C. 154(b) by 24 days.

(21) Appl. No.: 11/991,204

(22) PCT Filed: Mar. 6, 2007

(86) PCT No.: PCT/AU2007/000275

§ 371 (c)(1),
(2), (4) Date: Feb. 27, 2008

(87) PCT Pub. No.: WO2007/101299

PCT Pub. Date: Sep. 13, 2007

(65) Prior Publication Data

US 2009/0255190 A1 Oct. 15, 2009

(30) Foreign Application Priority Data

Mar. 6, 2006 (AU) ..... 2006901121

(51) Int. Cl.
*E05D 5/06* (2006.01)

(52) U.S. Cl. ..... 52/11; 52/12; 52/15; 248/48.2; 248/37.6

(58) Field of Classification Search ..... 52/11, 52/12, 14, 15; 16/388, 389, 391, 392; 248/48.1, 248/48.2, 37.3, 37.6; 24/295
See application file for complete search history.

(56) References Cited

U.S. PATENT DOCUMENTS

| | | | | |
|---|---|---|---|---|
| 304,425 | A * | 9/1884 | Gould | 248/48.2 |
| 4,309,792 | A * | 1/1982 | Faye | 16/389 |
| 4,561,616 | A | 12/1985 | Robinson | |
| 4,745,657 | A * | 5/1988 | Faye | 16/226 |
| 5,127,133 | A | 7/1992 | Buckner | |
| 5,274,965 | A * | 1/1994 | Jackson | 52/11 |
| 5,335,460 | A * | 8/1994 | Smith, Jr. | 52/11 |
| 5,649,681 | A * | 7/1997 | Faye | 248/48.1 |
| 5,884,876 | A * | 3/1999 | Axford | 248/48.2 |
| 5,893,239 | A * | 4/1999 | Leahy | 52/11 |
| 6,240,679 | B1 * | 6/2001 | Smalara | 52/16 |
| 6,269,592 | B1 * | 8/2001 | Rutter | 52/12 |
| 6,389,755 | B1 * | 5/2002 | Wenner | 52/16 |
| 6,651,937 | B1 * | 11/2003 | Wilson | 248/48.1 |

FOREIGN PATENT DOCUMENTS

| | | |
|---|---|---|
| AU | A-27073/92 | 4/1993 |
| GB | 2260774 A | 4/1993 |
| WO | WO 2005/106159 A1 | 11/2005 |

* cited by examiner

*Primary Examiner*—Richard E Chilcot, Jr.
*Assistant Examiner*—Chi Nguyen

(57) ABSTRACT

The present invention relates to a rotatable gutter support assembly that can rotate the gutter from an operational position where the gutter is used to collect and divert water from a roof, to a cleaning or rotated position in which the gutter is sufficiently rotated downwardly so that its inside may be accessed from ground level. The cleaning position then enables one to clean the gutter by using a suitable brush or even simply by hosing with water. The present invention also relates to a gutter system using the above assembly.

15 Claims, 9 Drawing Sheets

BRACKET ASSEMBLY FOR SUPPORTING A ROTATABLE GUTTER SYSTEM

The present invention relates to a bracket or support assembly for gutters that enables rotatable or pivotable movement of gutters to facilitate cleaning and maintenance of the gutter.

BACKGROUND OF THE INVENTION

Homes and other buildings are typically constructed having some form of gutter system that serves to collect rainwater or other liquid from the roof and direct that water away from the house. A gutter generally comprises a longitudinal, rigid structure having a channel extending the length of the gutter. Typical styles of gutters that are available in Australia include D-gutters, fascia gutters, halfround gutters and O.G. gutters, which each serve the same purpose but are each contoured slightly differently. Generally, a first longitudinal side of the gutter is directly mounted to a fascia or other like structure immediately underneath the edge of a roof, and the opposed side generally terminates into a rounded edge. When water enters the channel, it is typically directed away from the gutter through one or more downpipes at its ends.

It is well known that gutter systems must be cleaned and maintained at constant intervals in order to avoid certain problems that may arise including gutter leakage, gutter damage and general clogging of the gutter channel and downpipe with foreign debris. For example, when build-up of foreign matter, such as leaves, occurs within a gutter channel or downpipe, the transport of water away from the gutter is restricted resulting in water build-up. Eventually, this build-up of water may lead to potentially larger problems such as water entering the attic, seepage of the water through the walls near the cornices, or damage to objects adjacent the gutter. Also, if the gutters are 'wet' for a long time, this increases the susceptibility to corrosion of the gutter.

There have been a number of attempts to overcome these problems including using gutter guards and other protective screening devices. These types of devices may succeed to a certain extent in preventing large debris from entering a gutter channel, however, they fail to prevent particulate matter from entering the channel so even when using gutter guards and similar devices, one must still clean the gutter channel at regular intervals.

Homeowners often talk of the difficulty in accessing the channel of a gutter for cleaning or for general maintenance. In conventional gutter systems, one is forced to either climb a ladder or mount the roof itself in order to clean the gutter channel and downpipes. This is not only difficult, but may also be dangerous and often results in the homeowner having to pay a specialist to complete the task on their behalf. There exist some prior art gutter systems which include means to pivot the gutter for easier access thereto, however, there are a number of problems associated with these apparatus.

Most existing pivotable systems involve the use of quite complex mechanisms for actuating pivot of the gutter. Those skilled in the art would know that the more parts involved in a gutter system, the more expensive the system is to manufacture and the more difficult the system is to operate. This also ultimately results in greater cost to the consumer. Further, complex componentry of a gutter system is much more susceptible to damage due to rain and wind as opposed to systems having simple mechanical parts and a smaller number of parts.

A further problem with existing pivotable gutters is that being bulky they are not visually pleasing. In addition, with the cross-sectional shapes of gutters being quite varied there is to the best knowledge of the author no system that can accommodate most if not all gutter types.

It is therefore an object of the present invention to overcome at least some of the aforementioned problems or to provide the public with a useful alternative.

SUMMARY OF THE INVENTION

Therefore in one form of the invention there is proposed a gutter bracket including: an anchor means adapted to be affixed to a substantially vertical surface below a roof edge; a gutter support to which said gutter is fixed, said gutter support configured to allow movement of said gutter from a first operational position to a second position in which said gutter is more easily accessible; and a locking means adapted to releasably maintain said gutter in said first operational position.

Preferably said locking means is rotatably connected to an upper portion of said anchor means and moveable between a first position in which said gutter support is engaged by the locking means and thereby maintained in said first operational position, and a second position in which the gutter support and locking means are disengaged.

Preferably said locking means is connected to the anchor by at lease one arm, said at least one arm including a projecting lip which extends outwardly with respect to said vertical surface when the locking means is in said first position.

In preference said gutter support includes an upright surface to which said gutter is attached and a perpendicular base surface upon which said gutter sits, said gutter support being rotatably connected at a junction between said upright and base surfaces to a lower portion of said anchor.

In preference said upright surface includes a projecting lip of corresponding shape to the projecting lip of said locking means.

Preferably said locking means maintains the gutter support in said first operational position by way of engagement of said correspondingly shaped projecting lips which prevents downward rotation of the gutter support.

Advantageously said locking means includes a plurality of adjoining arms extending outwardly from said vertical surface, said arms being adjustable relative to one another in order to accommodate different types of gutters.

Preferably said plurality of arms includes a first arm constituting said rear arm, a second arm which is outwardly moveable with respect to the first arm and lockable thereto, a third arm which is vertically moveable with respect to the second arm and lockable thereto, and a fourth arm which is outwardly moveable with respect to the third arm and lockable thereto.

In preference said rotatable connection between the gutter support and anchor is by way of a hinge connection.

In a further form of the invention there is proposed a gutter system of the type adapted to be mounted beneath a longitudinal roof edge, said gutter system including:

a longitudinal gutter portion;

a plurality of brackets mounted at spaced apart longitudinal intervals below said roof edge whereby each of said brackets includes an anchor means adapted to be affixed to a substantially vertical surface beneath the roof edge, a gutter support including an upright portion to which a rear surface of said gutter is attached and an outwardly extending transverse portion upon which said gutter sits, said gutter support configured to allow movement of said gutter from a first operational position to a second position in which said gutter is more easily accessible, said gutter bracket further including a locking means adapted to releasably maintain the gutter in said first operational position.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

Figure 1:
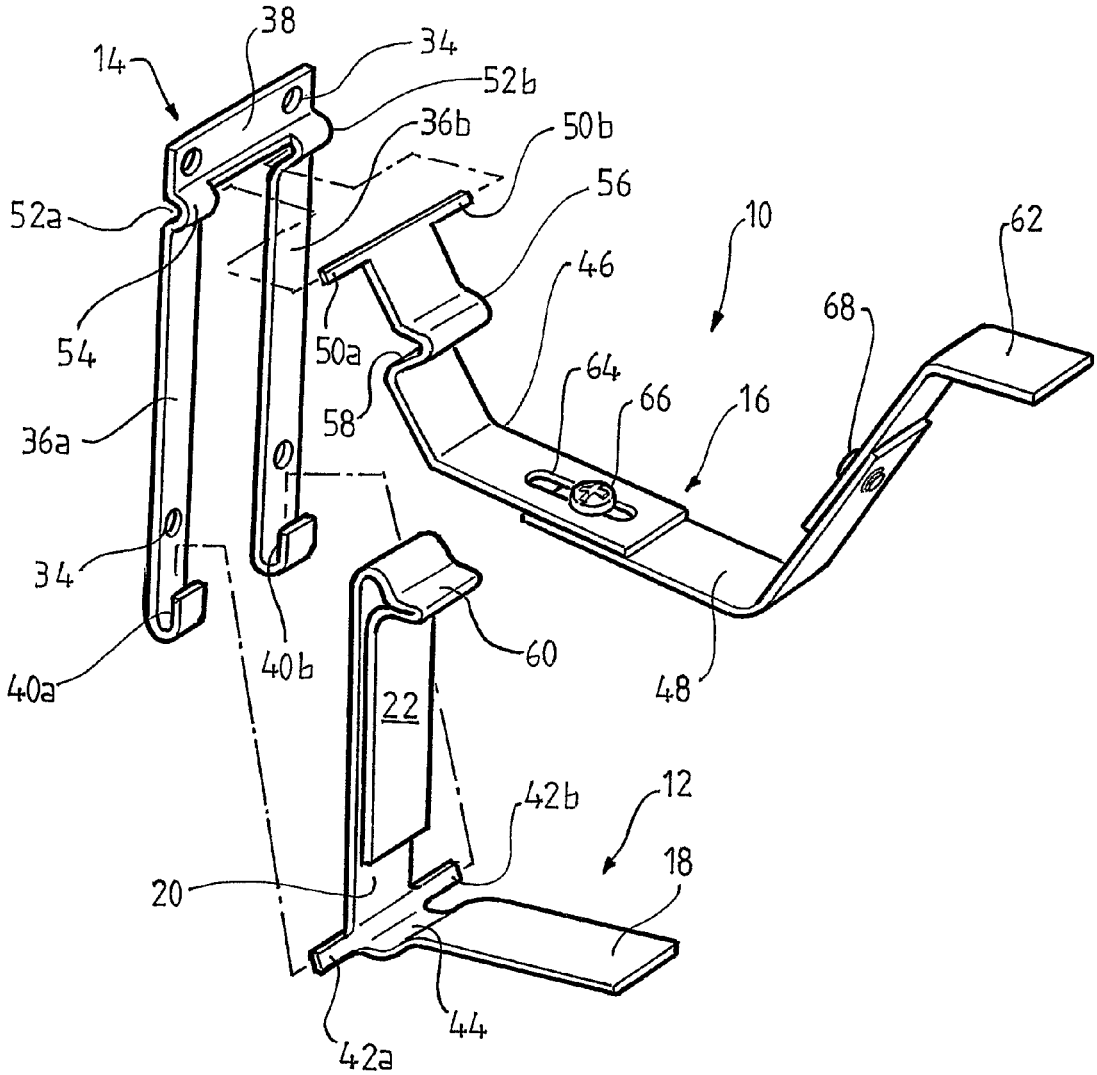
FIG. 1 illustrates in an exploded perspective view the individual components of the rotatable gutter support assembly.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to a rotatable gutter support assembly that can rotate the gutter from an operational position where the gutter is used to collect and divert water from a roof, to a cleaning or rotated position in which the gutter is sufficiently rotated downwardly so that its inside may be accessed from ground level. The cleaning position then enables one to clean the gutter by using a suitable brush or even simply by hosing with water. However the present invention also relates to a gutter system using the above assembly.

As illustrated in the Figures the assembly 10, according to a first embodiment, includes a gutter support 12 that rotatably engages anchor 14, and a locking mechanism 16 that also rotatably engages anchor 14. The gutter support, that we may call a bracket (not intended to be limited to a right angled one but to any useful shape) includes a base 18 extending outwardly from a rear upright wall 20 and flap 22 extending downwardly partially along the wall to enable the rear face 24 of gutter 26 to slide between the wall 20 and flap 24 and be fixed there by a suitable anchor such as rivet 28.

The anchor 14 is adapted to be fixed typically to a fascia 30 of a roof 31 using standard screws 32 passing through apertures 34 in the anchor 14. The anchor is typically of an inverted U-shape including two legs 36*a* and 36*b* joined across their top by cross-member 38. The bottom of each leg 36*a* and 36*b* is rounded upwardly to define semi-circular channels 40*a* and 40*b*. These channels are used to rotatably support gutter support 12 as now described.

The gutter support rear wall 20 is of a width that is less than the separation of the legs 36*a* and 36*b*. This allows the rear wall 20 to nestle within the anchor 14 so that the rear wall 24 of the gutter 26 sits nicely across the anchor 14 and wall 20 of the support 12. At or near the corner of the support 12 two arms 42*a* and 42*b* extend laterally outwards beyond the width of the base 18 or the wall 20 and are adapted to engage the respective channel 40*a* and 40*b*. The reader should now appreciate that this allows the support 12 to rotate downwardly with respect to the anchor 14. Since the gutter 26 is affixed to the support 12 this also causes the gutter to rotate downwardly.

To ensure that there is sufficient clearance for the installation and operation of the support and gutter, the section of the base 44 adjacent arms 42*a* and 42*b* dips downwardly so that the arms 42*a* and 42*b* are no higher than the upper surface of the base 18.

Figure 2:
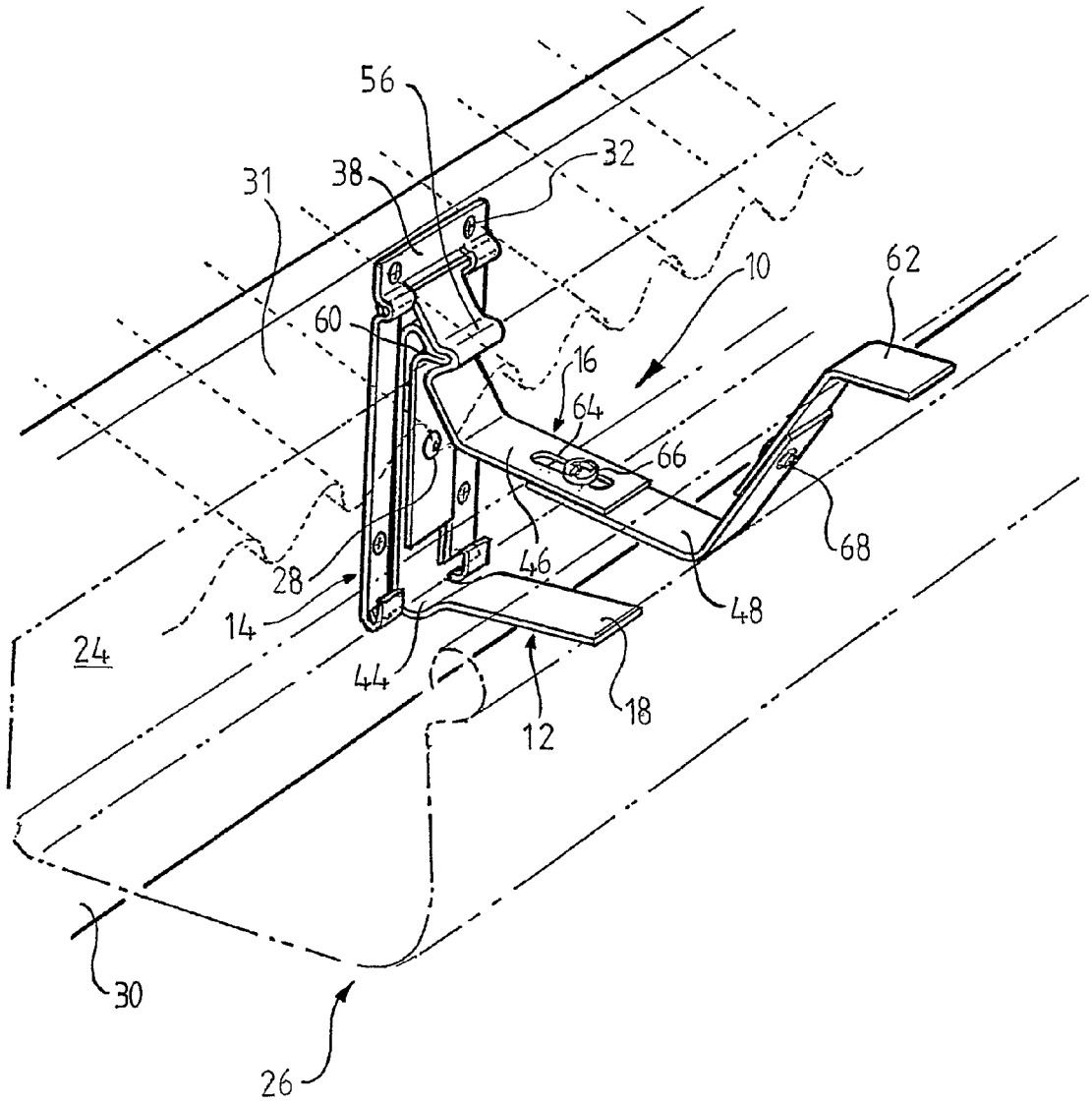
FIG. 2 is the assembly when supporting the gutter in its operational position.
Figure 3:
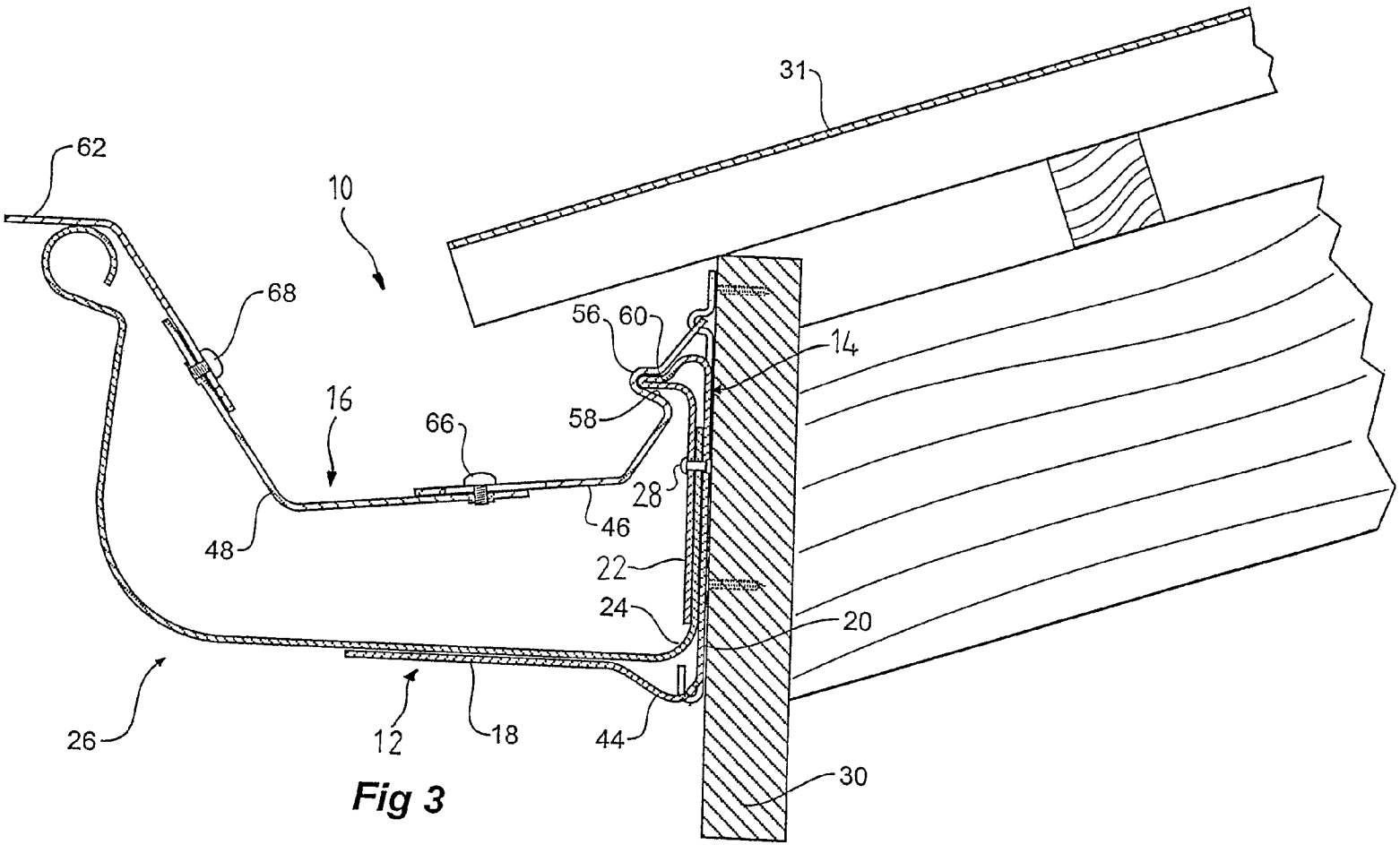
FIG. 3 is a cross-sectional view of the assembly of FIG. 2.

Locking mechanism 16 allows the gutter to be releasably retained in the operational position shown in FIG. 2 and FIG. 3. The locking mechanism consists of a rear and a front arm 46 and 48 respectively, adjustable with respect to each other the purpose of which shall be explained later. Rear arm includes at is outer end two extending projections 50*a* and 50*b* that engage channels 52*a* and 52*b* defined by bends 54 in the legs of the anchor 14 at a location adjacent cross-member 38 and facia 30. This allows the support 18 to rotate with respect to the anchor 14 whilst being held in place.

The rear arm 46 near its outer end includes a kink 56 that defined in part an inner abutment surface 58. A similarly shaped lip 60 in support 18 engages this surface 58. One would appreciate that in its operational position the surface 58 is abutted by lip 60 preventing it from disengaging and locking the gutter support and thus the gutter from rotating. To unlock the gutter, the locking mechanism is pushed upwards rotating around its projections 50*a* and 50*b* and releasing the lip 60 from abutting surface 58.

Figure 4:
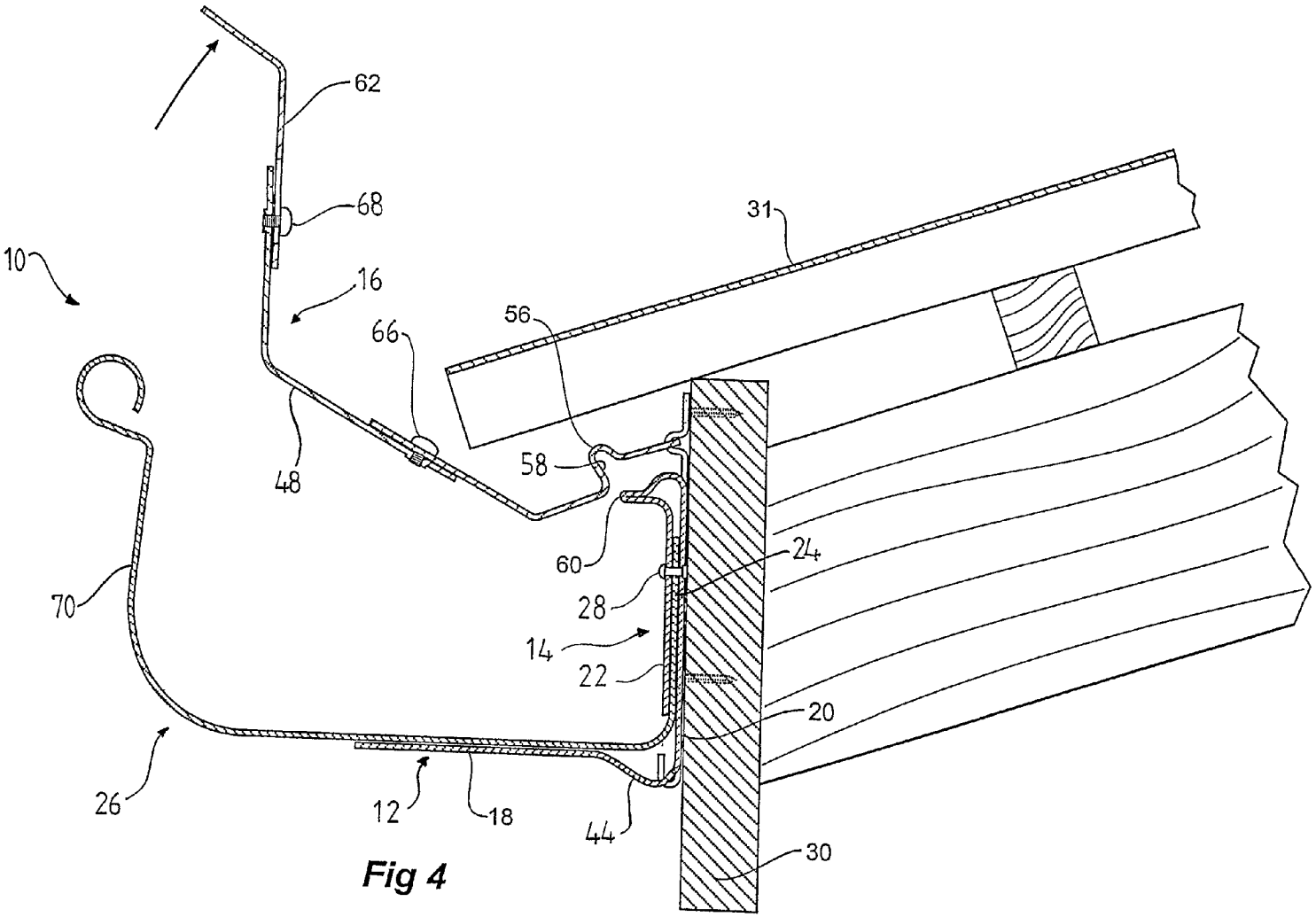
FIG. 4 is a cross-sectional view as in FIG. 3 but when the locking mechanism is unlocking the assembly.
Figure 5:
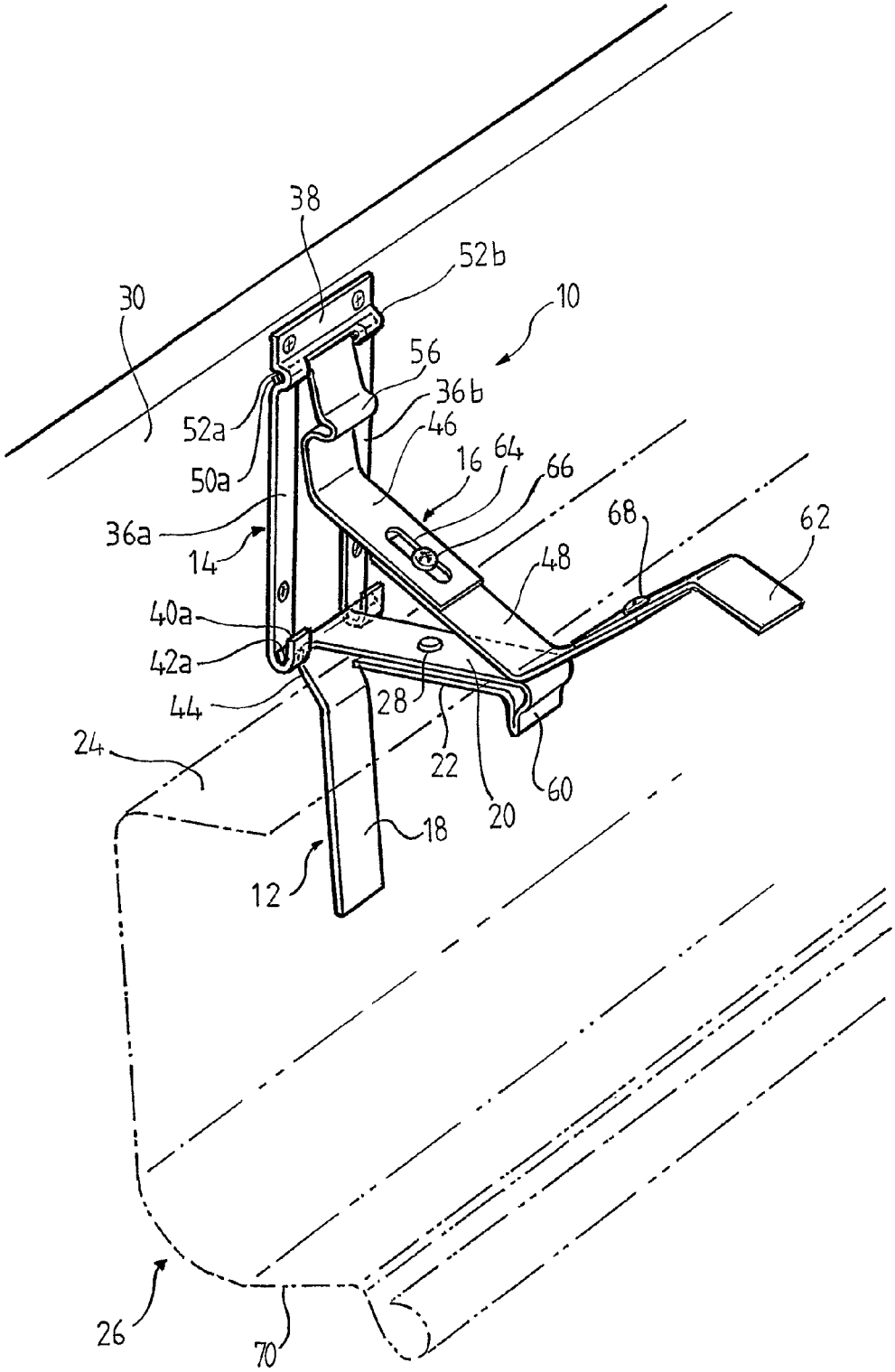
FIG. 5 is a perspective view of the assembly when the gutter is in the cleaning or rotated position.

To enable the locking mechanism to be activated the front arm 46 includes a handle 62 that projects beyond the gutter, as best seen in FIG. 3. Now one should appreciate the purpose of the adjustability between the rear and front arms. To be able to access the locking mechanism say from ground level one may use a pole to push up on the mechanism, as shown in FIG. 4. However, some gutters may be of different widths. Thus the adjustability of the length of the arm although not essential, is certainly a preferred feature to enable the present assembly to be used on gutters of various widths. Although many different types of adjustments may be possible, this embodiment illustrates an adjustment type where the rear arm includes a slit 64 engaged by screw 66 in the front arm 48.

The handle 62 may also be a separate part of the locking mechanism enabling different profiles and lengths of handles to be attached to the front arm by use of a simple screw 68.

Figure 6:
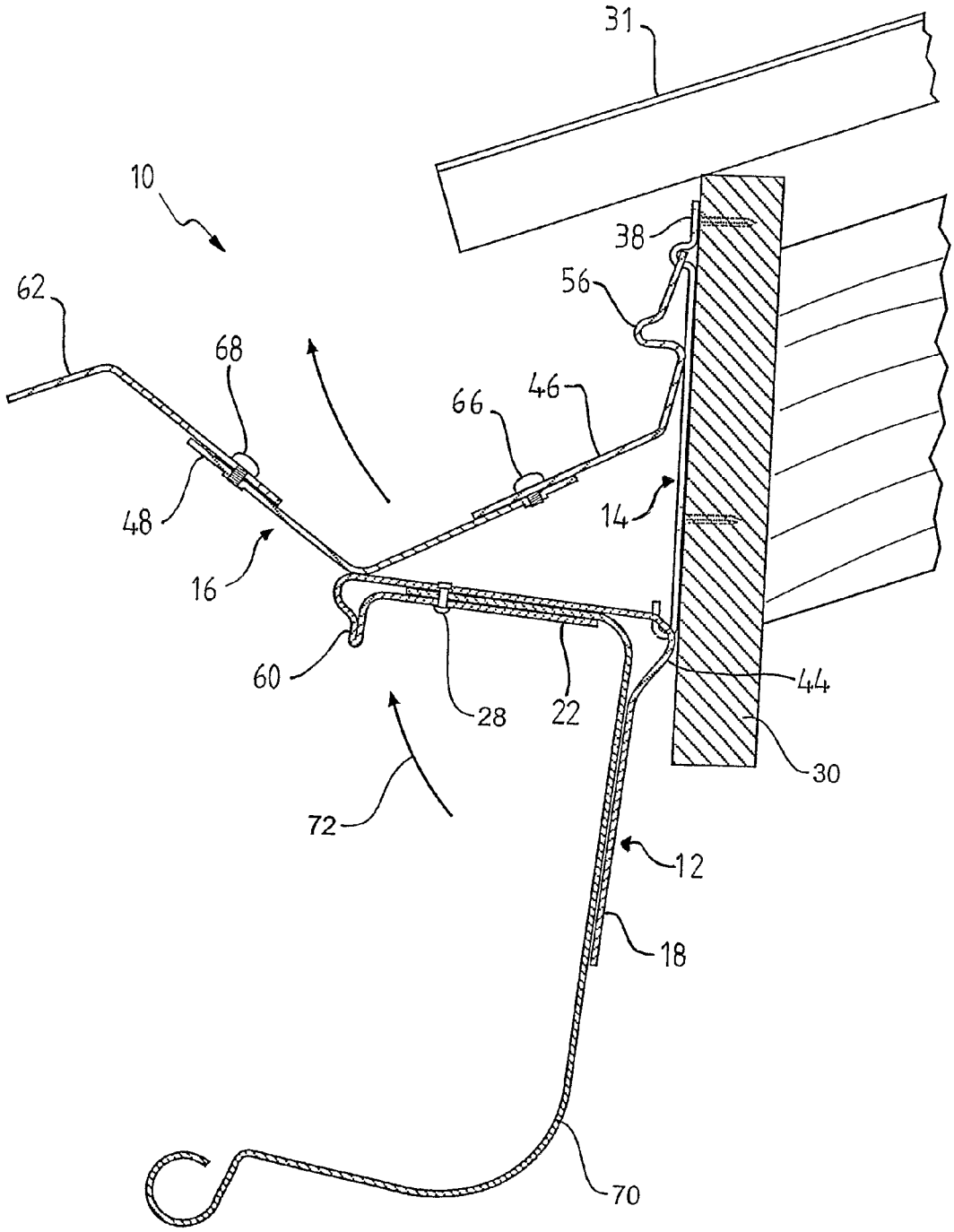
FIG. 6 is a cross-sectional view illustrating how the assembly is moved to its operational position from the cleaning position.

It is important to note that the actual shape of the locking mechanism is not critical provided that the shape acts to lock the support into position and enables it to be unlocked. An important consideration is to ensure that when in the cleaning or unlocked position, the locking mechanism arms do not abut against the rear wall of the support in a manner that may also lock it into position. This is important for typically the gutter will be rotated back into its operational position by acting against the front wall 70 of the gutter in direction 72, the support then acting on the locking arms, as best illustrated in FIG. 6.

Figure 7:
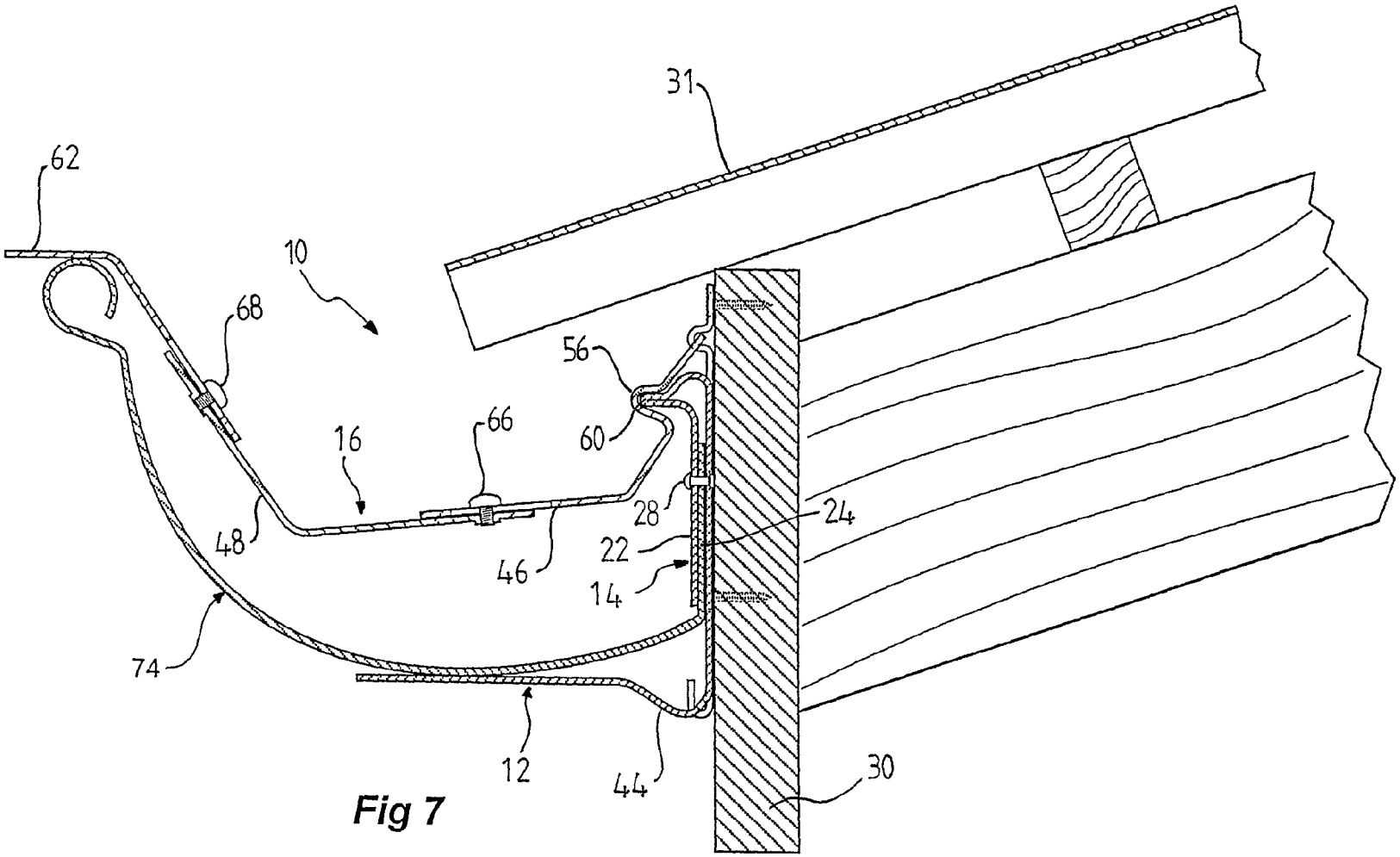
FIG. 7 illustrated the use of the assembly on a different gutter type.

The present invention provides for a very effective but simple solution that allows gutters to be rotated to a cleaning position from ground level without complicated arrangements. It further allows the assembly to be used on different shaped gutters, such as gutter 74 in FIG. 7, this feature not found in any other known gutter support assemblies.

Figure 8:
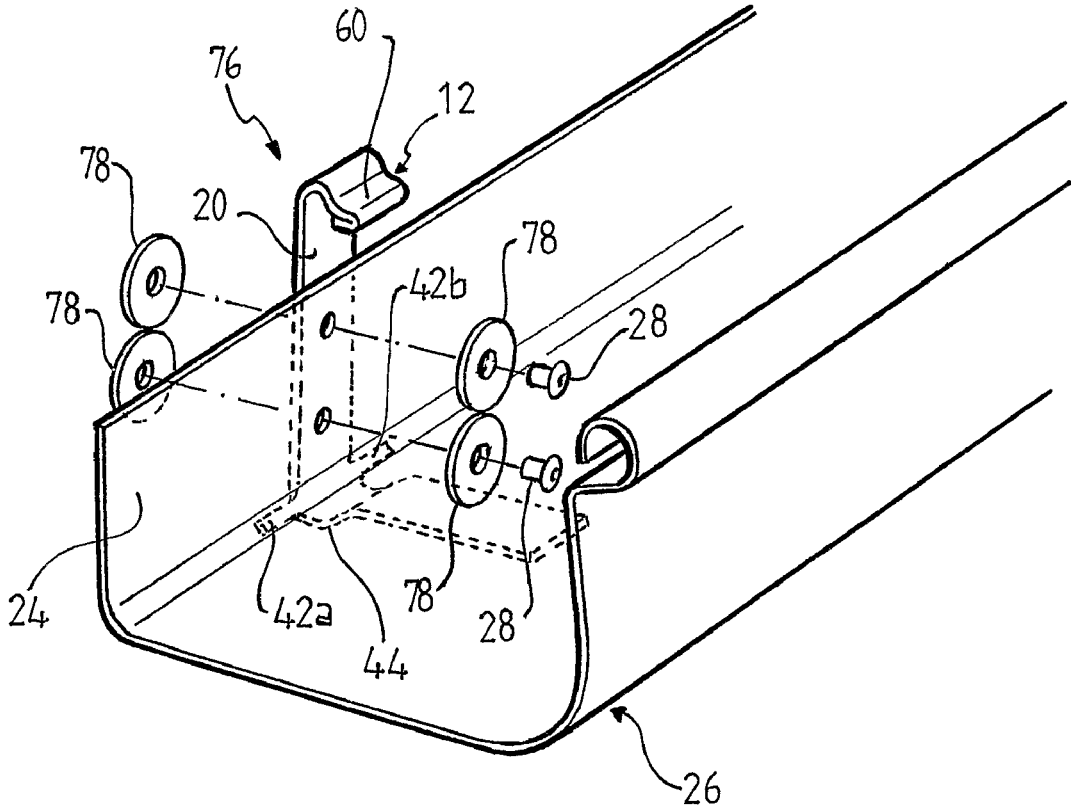
FIG. 8 illustrates a perspective view of a different embodiment of the support part of the assembly.

It is important to note that the invention is not intended to be limited to the particular configuration described above. FIG. 8 illustrates such an alternative assembly 76 whereby the shape of the support 12 is more simplified in that it does not include flap 22 to envelop around the rear wall 24 of the gutter 26, but rather uses washers 78 to directly fix the gutter rear wall 24 to the rear wall 20 of the support 12.

Figure 9:
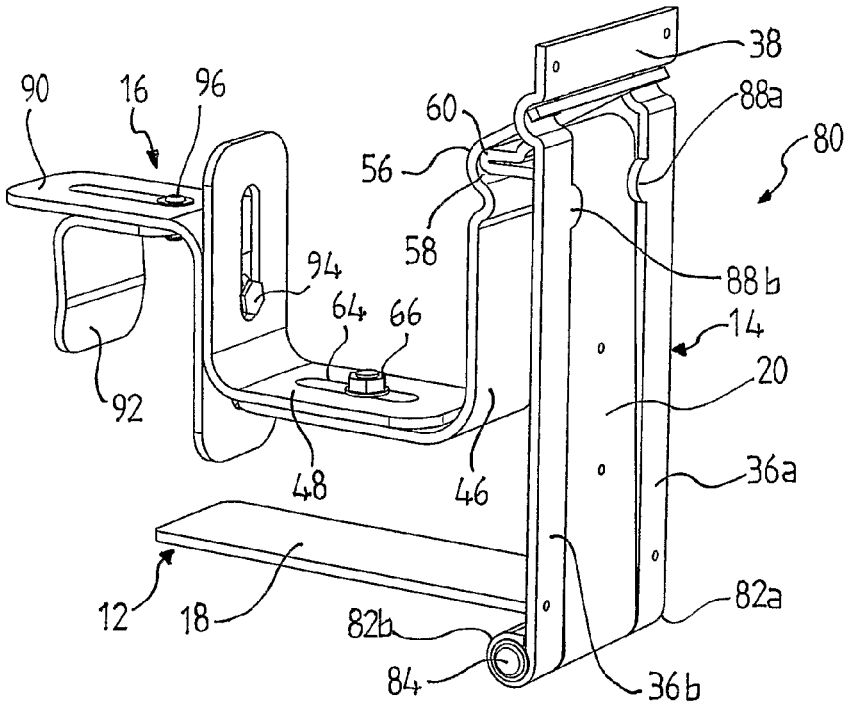
FIG. 9 illustrates a rear perspective view of a bracket assembly according to a preferred embodiment of the present invention.
Figure 10:
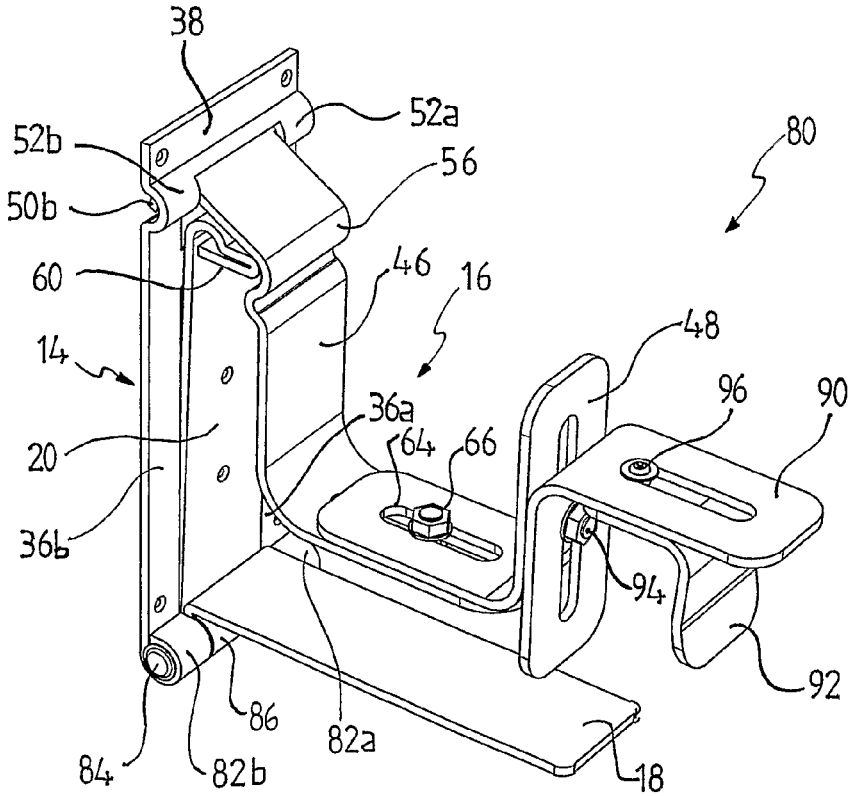
FIG. 10 illustrates front perspective view of the bracket assembly of FIG. 9.

FIGS. 9-10 illustrate a preferred embodiment of the present invention. This assembly 80 is similar to assembly 10 in many respects and so like numerals will be used to refer to like parts.

As with the assembly shown in FIG. 8, the support 12 of bracket assembly 80 does not include flap 22 but is intended to directly engage the gutter (not shown) using washers and rivets (which are not shown). The way in which the anchor 14 and support 12 engage is also slightly different. The bottom of each leg is rounded upwards and inwards to form circular apertures 82*a* and 82*b* adapted to rotatably engage a cylindrical rod 84 associated with support 12 and thereby form a hinge-like connection. The cylindrical rod 84 is fixedly enclosed within a correspondingly shaped housing 86 formed integrally with base 18 of support 12. The housing 86 is of a width to fit between arms 36*a* and 36*b*, and a diameter approximately equal to the circular apertures 82*a* and 82*b*. The cylindrical rod 84 replaces arms 42*a* and 42*b* of support 12 in assembly 10 to form a hinge-like connection between anchor 14 and support 12 without the need for the base 18 to dip downwardly adjacent the connection.

A further difference is that the upright wall 20 of the support 12 is prevented from movement between the arms 36*a* and 36*b* of the anchor 14 by semicircular shoulders 88*a* and 88*b* extending inwardly from arms 36*a* and 36*b* respectively. This allows the anchor 14 to be mounted flush with the fascia 30 given that there is now space between the upright wall 20 and fascia 30 to allow for washers, rivets and the like which connect the gutter 26 to the upright wall 20.

Finally, the locking mechanism 16 is also configured slightly differently. The rear arm 46 and front arm 48 serve the same purpose, however, in this preferred embodiment they include right-angled panels. They are still connected using a slit 64 engaged by a screw as described above. The handle 62 of assembly 10 is replaced with two further L-shaped arms 90 and 92 whereby arm 90 and arm 48 are engaged using screw 94, and arm 92 and arm 90 are engaged using screw 96. Each of the slits associated with these connections have been numbered using reference numeral 64 for the purpose of brevity. The skilled address would realise that each of the arms 46, 48, 90 and 92 are adjustable and fixable relative to adjacent arms to allow for any shape and size of gutter 26. The outermost arm 92 is adapted to be pushed up against the front of the gutter 26 and subsequently locked in place using screw 96 to act as a further support for the gutter 26. It is to be understood that each panel of the arms could be of different lengths to that which is shown in the Figures.

With the assemblies embodied herein being almost all located behind or within the gutter it is not seen from ground level thereby maintaining the aesthetic appeal of gutters as are now. The assembly could be finished in the same pattern or colour as the gutters. It is also to be noted that additional mechanisms that may mechanically lock and unlock the assembly may also be installed.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A gutter bracket for a gutter, comprising:

an anchor affixable to a rear vertical structure surface, said anchor having associated therewith a rotatable locking arm;

a gutter support rotatably associated with said anchor, said gutter support being adapted to allow movement of the gutter from a first operational position to a second gutter support position, said gutter support including a lip that projects in a forward direction relative to said rear vertical structure, said rotatable locking arm including a correspondingly shaped portion adapted to engage said forwardly projecting lip to thereby prevent downward rotation of said gutter support and maintain the gutter in said first operational position, whereby an interior region thereof faces upwardly, said locking arm being upwardly rotatable to a second locking arm position, whereby said lip becomes disengaged and allows said gutter support to rotate to a gutter support second position, whereby said interior region of said supported gutter is more easily accessible, said gutter support being configured to freely rotate to said second gutter support position unless maintained in said first operational position by way of engagement between said locking arm and said lip.

2. The gutter bracket of claim 1, wherein said rotatable locking arm includes a plurality of adjoining arms that are adjustable relative to one another in order to accommodate gutters of different cross sectional dimension.

3. The gutter bracket of claim 2, wherein said plurality of adjoining arms includes a first arm having associated therewith said lip engaging portion, a second arm that is moveable in a forward direction with respect to said first arm and lockable thereto, a third arm that is vertically moveable with respect to said second arm and lockable thereto, and a fourth arm that is moveable in a forward direction with respect to said third arm and lockable thereto.

4. The gutter bracket of claim 3, wherein said fourth arm is shaped to extend over an upper forwardmost edge of the gutter.

5. The gutter bracket of claim 1, wherein said lip is adapted to be disposed inside said correspondingly shaped portion of the locking arm when two components are engaged.

6. The gutter bracket of claim 1, wherein said locking arm and said support member are arranged such that when said gutter support is moved from said gutter support second position back to said first operational position, said gutter support by way of contact with the locking arm rotates said locking arm upwardly to a third locking arm position, whereby said locking arm automatically engages said lip and thereby locks the gutter in said first operational position.

7. The gutter bracket of claim 1, wherein said gutter support includes a vertical component having upper and lower portions, said lip being disposed at said upper portion, said lower portion being rotatably connected to said anchor.

8. The gutter bracket of claim 7, wherein said gutter support further includes a horizontal component adapted to extend beneath the gutter, the gutter being fixed to said vertical component.

9. A gutter bracket comprising:

a vertical anchor component affixable to a rear vertical structure surface, said vertical anchor component including upper and lower portions;

a gutter support including a vertical component having upper and lower portions, whereby said lower portion of said gutter support vertical component is rotatably associated with said lower portion of said anchor, said gutter support being moveable between a first operational position, whereby an interior region of a supported gutter faces upwardly and a second gutter support position, whereby the gutter is positioned to facilitate easy access to an interior region of the gutter, said gutter support being configured to rotate forwardly away from said vertical structure surface unless it is locked in said first operational position;

a forwardly projecting lip associated with said upper portion of said gutter support vertical component; and a locking arm rotatably associated with said upper portion of said vertical anchor component, said locking arm including a portion that is correspondingly shaped with said forwardly projecting lip and adapted to engage said lip to thereby prevent downward rotation of said gutter support and thereby maintain the gutter in said first operational position, whereby said an interior thereof faces upwardly, said locking arm being upwardly rotatable to a locking arm position, whereby said lip becomes disengaged from said locking arm thereby allowing said gutter support to rotate to said second gutter support position, whereby said interior region of the supported gutter is more easily accessible.

10. The gutter bracket of claim 9, wherein said locking arm extends forwardly to a point beyond the gutter for easy access to said locking arm, whereby when said locking arm is rotated upwardly to a first a predetermined angle from an engaged position, said lip is no longer held inside said correspondingly shaped portion and said gutter support is released.

11. The gutter bracket of claim 9, wherein said rotatable locking arm includes a plurality of adjoining arms being adjustable relative to one another in order to accommodate gutters of different cross sectional dimension.

12. The gutter bracket of claim 11, wherein said plurality of arms includes a first arm having associated therewith said lip engaging portion, a second arm that is moveable in a forward direction with respect to said first arm and lockable thereto, a third arm that is vertically moveable with respect to said second arm and lockable thereto, and a fourth arm that is moveable in a forwards direction with respect to said third arm and lockable thereto.

13. The gutter bracket of claim 12, wherein said fourth arm is shaped to extend over an upper forwardmost edge of the gutter.

14. The gutter bracket of claim 9, wherein said lip is adapted to fit snugly inside said correspondingly shaped portion of the locking arm when the two components are engaged.

15. The gutter bracket of claim 9, wherein said locking arm and said support member are arranged, whereby said gutter support is moved from said second gutter support position back to said first operational position, said gutter support by way of contact with said locking arm rotates said locking arm upwardly to a position, whereby said locking arm automatically engages said lip and thereby locks the gutter in said first operational position.

* * * * *